US007159435B2

(12) United States Patent
Feldmann et al.

(10) Patent No.: US 7,159,435 B2
(45) Date of Patent: Jan. 9, 2007

(54) APPARATUS FOR STRAIGHTENING PIPE

(75) Inventors: Uwe Feldmann, Rommerskirchen (DE); Manfred Kolbe, Mönchengladbach (DE); Arno Topüth, Mönchengladbach (DE); Hans-Jürgen Fischer, Mühlheim (DE)

(73) Assignee: SMS Meer GmbH, Monchengladbach (DE)

( * ) Notice: Subject to any disclaimer, the term of this patent is extended or adjusted under 35 U.S.C. 154(b) by 70 days.

(21) Appl. No.: 10/994,206

(22) Filed: Nov. 19, 2004

(65) Prior Publication Data

US 2005/0126252 A1 Jun. 16, 2005

(30) Foreign Application Priority Data

Nov. 21, 2003 (DE) ..... 103 54 554

(51) Int. Cl.
*B21D 41/02* (2006.01)

(52) U.S. Cl. ..... 72/316; 72/370.01; 72/20.1

(58) Field of Classification Search ..... 72/393, 72/370.08, 370.01, 113, 125, 122, 293, 126, 72/31.06, 316, 370.07, 370.05, 31.08, 392
See application file for complete search history.

(56) References Cited

U.S. PATENT DOCUMENTS

| | | | | |
|---|---|---|---|---|
| 816,451 | A * | 3/1906 | Forwood | 72/122 |
| 958,517 | A * | 5/1910 | Mettler | 166/217 |
| 3,077,916 | A * | 2/1963 | Vaughn | 72/393 |
| 4,574,442 | A * | 3/1986 | Dickinson et al. | 29/90.01 |
| 4,779,445 | A * | 10/1988 | Rabe | 72/393 |
| 6,457,532 | B1 * | 10/2002 | Simpson | 166/380 |
| 6,543,552 | B1 * | 4/2003 | Metcalfe et al. | 175/57 |

* cited by examiner

*Primary Examiner*—Lowell A. Lafson
*Assistant Examiner*—Teresa M. Bonk
(74) *Attorney, Agent, or Firm*—Andrew Wilford

(57) ABSTRACT

A straightening apparatus for large diameter thick wall pipe has an expander head at one end of a beam inserted into the pipe and having a radially displaceable saddle positionable at any selected location along the beam. The saddle may be shifted along the beam by a linear actuator and the saddle applies a radial force to the inner wall of the pipe in a bending operation.

19 Claims, 3 Drawing Sheets

APPARATUS FOR STRAIGHTENING PIPE

FIELD OF THE INVENTION

Our present invention relates to an apparatus for straightening pipe and, more particularly, to an apparatus of the type in which a radially expansible head is insertable in the pipe and a straightening saddle spaced from that head at a certain position along the longitudinal axis can be actuated to apply a radial force to an inner wall or surface of the pipe to straighten the latter.

BACKGROUND OF THE INVENTION

In the fabrication of pipe made, for example, from relatively thick plates, for instance by the UOE method, the press method or the three-roll bending method, a round elongated slitted tube is formed which is then welded closed along a continuous longitudinal weld seam. In the welding to form the pipe, the material from which the pipe is formed, generally thick sheet or plate steel, may be subjected to thermal stress. As a result of the welding process the pipe is distorted during fabrication and may not be straight, i.e. can have a banana shape. As a consequence, the pipe may have to be subjected to a straightening operation.

For the straightening of such pipe devices which engage the pipe from the exterior have been used by and large almost exclusively. The apparatus for this purpose may apply straightening rollers or saddles to the outer surface of the pipe with sufficient force to apply bending moments to the pipe and straighten the latter. The external bending devices may be used in conjunction with an expander head inserted into the pipe.

The devices which engage the pipe from the exterior require a significant superstructure adapted to take up the bending stresses that must be applied and which can be costly and occupy significant space.

Another drawback of conventional pipe straightening machines is that the straightening effect usually is effective only in one direction, for example, in a vertical direction which may require transmissions of the bending force over a long distance. The supporting structure in such cases may have a relatively high degree of elasticity and thus take up a significant part of the bending force by distortion. The result may not be satisfactory straightening.

Since pipes are fabricated with greater and greater wall thicknesses and materials of increasing strength, conventional pipe straightening equipment may have reached limits in straightening capacity and may not be able to straighten pipes manufactured more recently in an efficient and effective manner.

OBJECTS OF THE INVENTION

It is therefore the principal object of the present invention to provide a tube straightening device which avoids the drawbacks outlined above and, in particular, can permit a more efficient and less expensive process for fabricating pipe, especially steel pipe.

Another object of the invention is to provide a pipe straightening apparatus which is less sensitive to elasticity in support structures and, in addition, requires less expensive and more compact support structures than earlier pipe straightening systems.

It is also an important object of the present invention to decrease the cost and complexity of a pipe straightening apparatus.

SUMMARY OF THE INVENTION

These objects and others which will become apparent hereinafter are achieved in accordance with the invention in an apparatus for straightening a pipe which comprises:

a beam positionable within a pipe to be straightened along a longitudinal axis of the pipe;

a radially spreadable expansion head positionable in the pipe and engageable with an inner wall thereof;

at least one straightening saddle mounted on the beam and shiftable along a longitudinal axis of the beam to a position at a selected distance from the expansion head; and a mechanism acting upon the saddle for pressing the saddle radially outwardly with respect to the longitudinal axis of the beam against the inner wall of the pipe to straighten the pipe.

According to the invention a positioning device can be connected to the saddle for shifting it into the aforementioned position along the longitudinal axis of the beam. The expansion head can be located at an end of the beam and can have a plurality of radially outwardly spreadable segments displaceable perpendicularly with respect to the longitudinal axis of the beam.

In all cases herein the beam may be tubular or may have a solid cross section and can be of a round external periphery or of a polygonal cross section.

The mechanism can comprise a wedge which, while displaceable in translation along the longitudinal axis of the beam, can bear upon the saddle for radially displacing the saddle against the inner wall or surface of the pipe. The wedge can have a linear actuator and sensors can be provided for measuring a radial distance of the saddle from the longitudinal axis of the beam and for measuring a distance between that longitudinal axis and the inner wall of the pipe.

Thus with the system of the invention at least one straightening saddle cooperates with the expander head within the pipe to form the pipe straightening unit, the saddle being displaceable upon the bar shaped or tube shaped beam which can be inserted in the pipe.

The saddle is shiftable along the longitudinal axis of the beam and means can be provided whereby the saddle is pressed radially outwardly from the longitudinal axis of the beam against the inner surface of the pipe.

Since the straightening saddle or saddles are simultaneously pressed outwardly against the interior of the pipe with the expansion of the head, the system allows an effective prepositioning of the saddle or saddles relative to the expander head and enables the system to utilize the multiaxial stress to optimize the flow or plastic movement of the material constituting the pipe to bend it straight. A force flow in a tight space is here provided without the transfer of force over long distances and without the need for an expensive superstrucutre.

The expander head at the end of the beam can be simply braced against that end, affixed to that end e.g. by welding, or coupled to the end in another way. The mechanism actuating the or each saddle can be provided on a plate or other carrier with the saddle which can be shiftable along the beam, e.g. by another linear actuator.

The apparatus of the invention thus allows straightening of large diameter thick-wall pipe in an advantageous manner with a relatively short force transmission distance between the expander head and the straightening saddle and thus the application of force with greater precision then has hitherto been the case. The efficiency of the apparatus and the pipe fabrication process is thereby improved and the propositioning enables the straightening apparatus to be located at any position within the pipe.

The invention can utilize a straightening saddle which can be shifted anywhere along the beam, e.g. on the carrier plate and thus even permits remote control of the location at which the saddle will be effective. The pipe is bent from the interior and straightened with the short force flow distances described.

The magnitude and direction of the straightening moment can be adjustable for each expansion step of the pipe individually so that the straightening process is thereby optimized.

When the data with respect to the pipe is detected by the sensors, the straightening process can be at least partly automated and even when no automation is intended can allow interactive manual control.

BRIEF DESCRIPTION OF THE DRAWING

The above and other objects, features, and advantages will become more readily apparent from the following description, reference being made to the accompanying drawing in which.

SPECIFIC DESCRIPTION

A large-diameter thick-wall pipe 2 formed after welding along a longitudinal seam is not ideally straight. To eliminate the deviation from straightness, the apparatus 1 for straightening the pipe is inserted into the interior thereof. The apparatus 1 comprises a beam 4, here shown to be tubular. Alternatively the beam 4' may be used (FIG. 3) which has a solid cross section and the configuration of a bar.

The longitudinal axis $L_T$ of the beam 4 is identical with the longitudinal axis L of the pipe.

Figure 1:
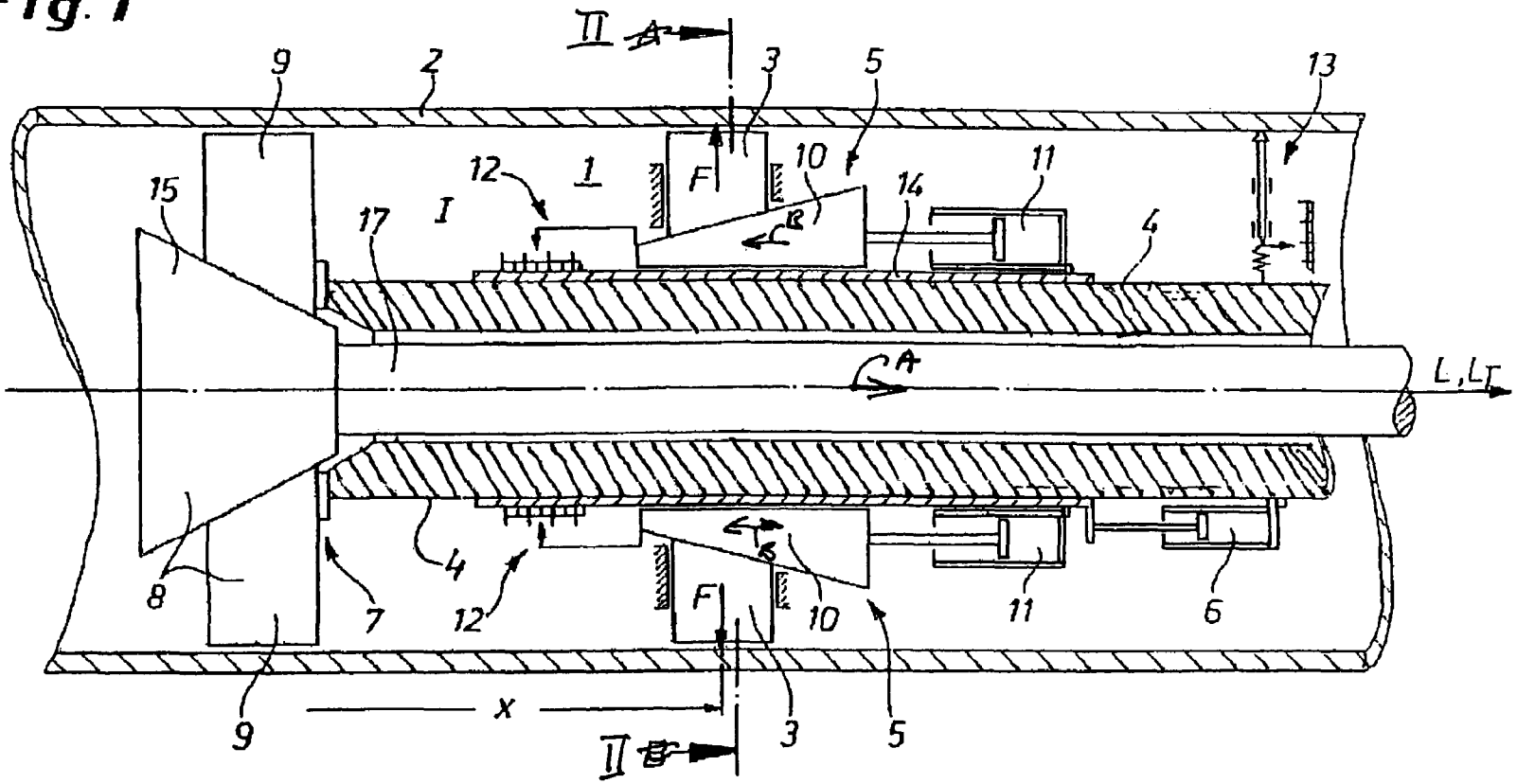
FIG. 1 is a diagrammatic cross sectional view of an apparatus for straightening a large-diameter thick-wall pipe in accordance with the invention.

At one axial end 7, the beam 4 abuts against an expander head 8. The expander head 8 has a plurality of segments 9 uniformly angularly spaced about the axis $L_T$ which can be displaced outwardly, i.e. perpendicular to that axis by a frustopyrimidal driver 15. The latter can be drawn by a tension rod 17 in the direction of the arrow A. The frustopyramid can be displaced in the embodiment of FIG. 3 by other means to expand the head 8. The frustopyramid 15 displaces the segments 9 radially outwardly. In FIG. 1 only the two vertical segments above and below the frustopyramid 15 have been shown. The pipe 2, the head 8 the beam 4 and the tension rod 17 are all coaxial to one another. The beam 4 is fixed in its axial position with respect to the segments 9 and may be welded to the head 8 in the embodiment of FIG. 3. It is thus possible to displace the segments 9 outwardly by a relative displacement of the tension rod 17 and the beam.

Figure 3:
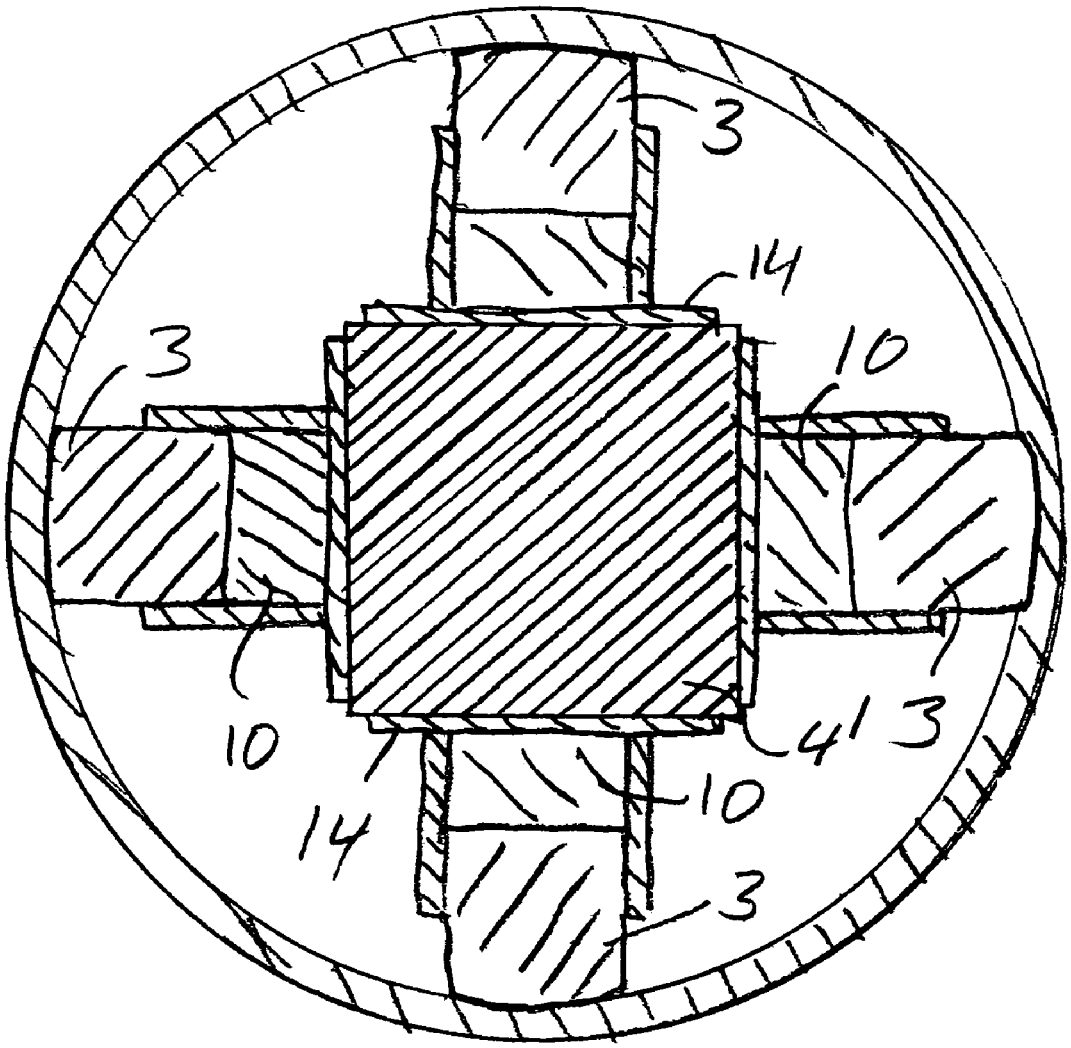
FIG. 3 is a view similar to FIG. 2 of an embodiment in which a bar-shaped beam is used.

On the beam 4, a carrier 14 is provided. In FIG. 3 the carrier is shown to be a number of carrier plates 14. The carrier 14 can be positioned relative to the beam 4 by a positioning device in the form of a linear actuator, in FIG. 1 shown as a fluid pressurizable cylinder. The positioning device 6 serves to locate the saddle 3 at a desired position from the expansion head along the beam 4. On the carrier or carriers, wedges 10 are provided which themselves are displaceable by linear actuators 11 e.g. in the direction of arrows B to the drive the straightening saddles 3 outwardly in a direction perpendicular to the longitudinal axis $L_T$ this produces an outwardly directed force F upon the inner surface of the pipe 2 to straighten the latter.

Figure 2:
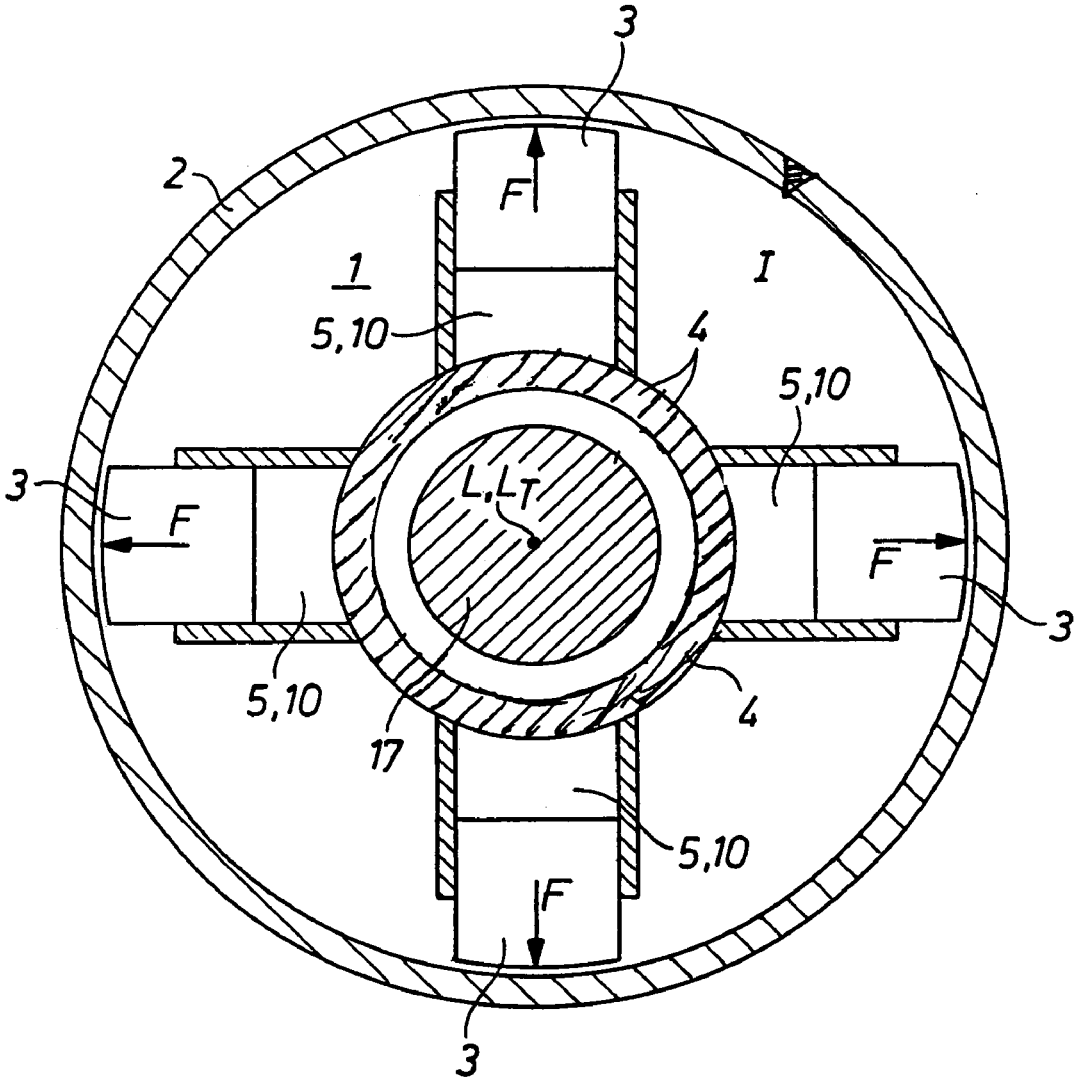
FIG. 2 is a section along the line II—II of FIG. 1 with the carrier plates omitted.

As can be seen from FIG. 2, in which the carriers 14 have been omitted, four such saddles 3 in angularly equispaced relationship about the periphery of the beam 4 can be provided.

By corresponding control of the linear actuators 11 the force F is supplied precisely whereby prepositioning of the saddles in cooperation with the head, it is required to bend the pipe 2 into a line to straighten the pipe.

The actual displacement of the wedges 10 relative to the beam can be detected by respective sensors 12 which measure the linear displacements of the wedges and thus the degree to which the straightening saddles 3 are driven outwardly so that the requisite F forces can be applied to the inner wall of the pipe for the straightening operation.

On the beam 4, another measuring device or sensor 13 can be provided for measuring the spacing between the inner surface of the pipe and beam 4 or its axis $L_T$. These sensors 13 can likewise be uniformly spaced about the axis.

FIG. 1 has shown that the sensor 13 is fixed to the beam 4 and measures the spacing to the inner pipe wall. The measuring device 13 however can alternatively be provided on the or each support carrier 14 and can shift relative to the beam 4 on the support plate.

It is possible to control the linear actuators 6 and 11 via signals from the sensors 12 to enable the straightening process to be completely or partially automated. For such automation or to provide support for the straightening process, control or regulation circuitry including a computer can be provided to detect the position of the inner wall of the pipe 2 with the sensor 13 at different positions along the pipe 2.

The sensors 12 provide information with respect to the radial position of the radially outwardmost ends of the straightening saddle 3. This information can be processed based upon known algorithms as to the axial position x, to yield the force required to straighten the pipe 2 at the respective saddle 3. In conjunction with the expansion head 8, these forces apply such bending moments to the pipe to enable the highest degree of straightening to be obtained. The radial movements of the saddles are effected in the embodiments of FIGS. 1, 2 and the embodiment of FIG. 3 by wedges. As alternatives it is possible to use spindles, hydraulic cylinders or like actuators.

The straightening saddles can be configured as plates or, to allow compensation for expansion and contraction of the pipe 2 in the longitudinal direction, also as plate roller segments or as slide plates.

While the linear actuators 6 and 11 have been shown as piston and cylinder assemblies by way of example, it can be noted that each of them can be replaced by an electrically operated spindle system.

While FIGS. 2 and 3 show four straightening saddles uniformly spaced about the longitudinal axis, for straightening purposes at least one said saddle is required. The greater the number of such saddles the more precise can be the straightening action.

We claim:

1. An apparatus for straightening a pipe, the apparatus comprising:

a beam positionable within a pipe to be straightened along a longitudinal axis of said pipe;

a radially spreadable expansion head positionable in said pipe and engageable with an inner wall thereof;

at least one straightening saddle mounted on said beam and shiftable along a longitudinal axis of said beam to a position at a selected distance from said expansion head;

a mechanism acting upon said saddle for pressing said saddle radially outwardly with respect to the longitudinal axis of said beam against said inner wall of said pipe to straighten the pipe; and a positioning device connected to the saddle for shifting same into the position alone the longitudinal axis of the beam.

2. The apparatus defined in claim 1 wherein said expansion head is located at an end of said beam and has a plurality of radially outwardly spreadable segments displaceable perpendicularly with respect to the longitudinal axis of the beam.

3. The apparatus defined in claim 1 wherein a plurality of said straightening saddles are provided on said beam and are angularly equispaced around said longitudinal axis of said beam.

4. An apparatus for straightening a pipe, the apparatus comprising:

a beam positionable within a pipe to be straightened along a longitudinal axis of the pipe;

a radially spreadable expansion head positionable in the pipe and engageable with an inner wall thereof:

at least one straightening saddle mounted on the beam and shiftable along a longitudinal axis of the beam to a position at a selected distance from the expansion head; and a mechanism acting upon the saddle for pressing the saddle radially outward with respect to the longitudinal axis of the beam against the inner wall of the pipe to straighten the pipe, said mechanism comprising a respective wedge displaceable in translation along said longitudinal axis of said beam and bearing upon the respective saddle for radially displacing the saddle against the inner wall of the pipe.

5. The apparatus defined in claim 1, further comprising a linear actuator for said wedge.

6. An apparatus for straightening a pipe, the apparatus comprising:

a beam positionable within a pipe to be straightened along a longitudinal axis of the pipe;

a radially spreadable expansion head positionable in the pipe and engageable with an inner wall thereof;

at least one straightening saddle mounted on the beam and shiftable along a longitudinal axis of the beam to a position at a selected distance from the expansion head;

a mechanism acting upon the saddle for pressing the saddle radially outward with respect to the longitudinal axis of the beam against the inner wall of the pipe to straighten the pipe; and at least one sensor for measuring a radial distance of said saddle from the longitudinal axis of said beam.

7. An apparatus for straightening a pipe, the apparatus comprising:

a beam positionable within a pipe to be straightened along a longitudinal axis of the pipe;

a radially spreadable expansion head positionable in the pipe and engageable with an inner wall thereof;

at least one straightening saddle mounted on the beam and shiftable along a longitudinal axis of the beam to a position at a selected distance from the expansion head;

a mechanism acting upon the saddle for pressing the saddle radially outward with respect to the longitudinal axis of the beam against the inner wall of the pipe to straighten the pipe; and at least one sensor on said beam for measuring a distance between said longitudinal axis of said beam and said inner wall of said pipe.

8. The apparatus defined in claim 7 wherein a plurality of said sensors are provided on said beam spaced equidistantly about said longitudinal axis of said beam.

9. An apparatus for straightening a pipe, the apparatus comprising:

a beam positionable within a pipe to be straightened along a longitudinal axis of the pipe;

a radially spreadable expansion head positionable in the pipe and engageable with an inner wall thereof;

a carrier shiftable in translation along said beam;

at least one straightening saddle mounted on the carrier and shiftable therewith along a longitudinal axis of the beam to a position at a selected distance from the expansion head; and a mechanism also mounted on the carrier and acting upon the saddle for pressing the saddle radially outward with respect to the longitudinal axis of the beam against the inner wall of the pipe to straighten the pipe.

10. The apparatus defined in claim 9 wherein said carrier is a carrier plate movable relative to said beam along said longitudinal axis of the beam.

11. The apparatus defined in claim 10, further comprising a positioning device connected to said carrier plate for shifting said saddle into said position along the longitudinal axis of said beam.

12. The apparatus defined in claim 11 wherein said expansion head is located at an end of said beam and has a plurality of radially outwardly spreadable segments displaceable perpendicularly with respect to the longitudinal axis of the beam.

13. The apparatus defined in claim 12 wherein said mechanism comprises a respective wedge displaceable in translation along said longitudinal axis of said beam and bearing upon the respective saddle for radially displacing the saddle against the inner wall of the pipe.

14. The apparatus defined in claim 13, further comprising a linear actuator for said wedge.

15. The apparatus defined in claim 14 wherein four of said straightening saddles are provided on said beam and are angularly equispaced around said longitudinal axis of said beam.

16. The apparatus defined in claim 15, further comprising at least one sensor for measuring a radial distance of said saddle from the longitudinal axis of said beam.

17. The apparatus defined in claim 16, further comprising at least one further sensor on said beam for measuring a distance between said longitudinal axis of said beam and said inner wall of said pipe.

18. The apparatus defined in claim 17 wherein a plurality of said further sensors are provided on said beam spaced equidistantly about said longitudinal axis of said beam.

19. An apparatus for straightening a pipe, the apparatus comprising:

a beam positionable within a pipe to be straightened along a longitudinal axis of the pipe;

a radially spreadable expansion head positionable in the pipe and engageable with an inner wall thereof;

a plurality straightening saddle mounted on the beam angularly equispaced about and jointly shiftable along a longitudinal axis of the beam to positions at a selected distance from the expansion head; and mechanism acting upon the saddle for pressing the saddle radially outward with respect to the longitudinal axis of the beam against the inner wall of the pipe to straighten the pipe.

* * * * *